US006255597B1

(12) United States Patent
Bowling et al.

(10) Patent No.: US 6,255,597 B1
(45) Date of Patent: Jul. 3, 2001

(54) WILDLIFE GUARD FOR ELECTRICAL INSULATOR BUSHINGS

(75) Inventors: David Edwin Bowling, Fuquay-Varina; Laura Jackson Hiller, Cary, both of NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/513,415

(22) Filed: Feb. 25, 2000

(51) Int. Cl.[7] ..... H01B 17/56
(52) U.S. Cl. ..... 174/138 F; 174/5 R; 174/139
(58) Field of Search ..... 174/5 R, 40 R, 174/135, 138 F, 139, 140 H, 47, 48

(56) References Cited

U.S. PATENT DOCUMENTS

| | | | | |
|---|---|---|---|---|
| 983,039 | * | 1/1911 | Field | 174/139 |
| 2,682,591 | * | 6/1954 | Killian | 174/139 |
| 2,875,267 | * | 2/1959 | Sutton | 174/139 |
| 3,042,736 | * | 7/1962 | Salisbury | 174/5 |
| 3,238,291 | * | 3/1966 | Bosch et al. | 174/138 |
| 3,270,120 | * | 8/1966 | Van name et al. | 174/1 |
| 3,510,568 | * | 5/1970 | Cochran | 174/5 |
| 3,639,681 | * | 2/1972 | Ettlinger | 174/138 F |
| 4,255,610 | * | 3/1981 | Textoris | 174/48 |
| 4,433,630 | * | 2/1984 | Laborie | 174/48 |
| 4,845,307 | | 7/1989 | Cumming et al. | 174/5 R |
| 5,650,594 | | 7/1997 | Urnovitz | 174/139 |
| 5,794,495 | | 8/1998 | Anderson | 81/53.1 |
| 5,864,096 | | 1/1999 | Williams et al. | 174/139 |
| 5,994,644 | * | 11/1999 | Rindoks et al. | 174/48 |
| 6,005,196 | | 12/1999 | Spillyards | 174/138 F |

* cited by examiner

*Primary Examiner*—Dean A. Reichard
*Assistant Examiner*—Adolfo Nino
(74) *Attorney, Agent, or Firm*—Myers Bigel Sibley & Sajovec

(57) ABSTRACT

Wildlife guards for surrounding electrical insulator bushings and electrical conductors extending therefrom include pivotally connected first and second cover portions. Each cover portion includes a respective lever arm configured such that when a force is applied to the first and second lever arms by a portion of an electrical insulator bushing, the first and second cover portions pivot together into engagement in a closed position surrounding the electrical insulator bushing and a portion of the electrical conductor extending from the electrical insulator bushing. A plurality of flexible fingers extending from adjacent edge portions of the cover portions allow an electrical conductor to extend therethrough while preventing the ingress of animals.

14 Claims, 4 Drawing Sheets

WILDLIFE GUARD FOR ELECTRICAL INSULATOR BUSHINGS

FIELD OF THE INVENTION

The present invention relates generally to insulating covers and, more particularly, to insulating covers for electrical insulator bushings.

BACKGROUND OF THE INVENTION

Electrical power may be transmitted from a generation source to consumers via overhead conductors strung between towers or poles. Electrical power is conventionally transmitted in phases wherein multiple conductors are utilized. One or more of these conductors may be a "hot" conductor that carries a specified amount of alternating current electric power. Flashover may result if contact is made between two hot conductors or between a hot conductor and ground. Non-grounded contact with a hot conductor, such as when a bird sits upon a hot conductor, typically does not result in flashover.

The transmission of electrical power from a generation source to residential areas typically involves a combination or transmission devices which make up a transmission system. In a typical transmission system, power is generated by a power plant such as a hydroelectric installation, a steam installation or a nuclear plant. The output from a power plant generator is normally about 25 kilovolts (kv). The output from a power plant generator is typically transmitted to a step-up substation where the voltage is increased to a transmission line voltage of 230 kv or higher. The next substation encountered is typically a transmission substation where the transmission voltage is decreased from the transmission line voltage to a sub-transmission voltage of approximately 69 kv. A distribution substation is then typically used to step the voltage down from the transmission voltage to a distribution voltage of about 5 to 35 kv. The distribution voltage is the voltage that is transmitted to a residential area, either through overhead or underground distribution systems. Single phase transformers are typically provided at the residential level to reduce voltage to a 240–120 volt, single phase, three wire residential power entrance.

Substations typically include various power transmission and distribution equipment, such as circuit breakers, transformers, capacitors, regulators, hook switches and the like. Uninsulated conductors typically extend between the equipment in a substation in various directions and configurations. To prevent arcing, electrical insulator bushings are typically provided about conductors at the point where the conductors extend from electrical transmission and distribution equipment housings.

Unfortunately, an electrical insulator bushing may act as a bridge for an animal moving between an uninsulated conductor and equipment from which the conductor extends. Although an electrical insulator bushing may prevent an animal from simultaneously touching the uninsulated conductor and the equipment, the length of some insulator bushings may be insufficient to prevent simultaneous contact between an uninsulated conductor and the equipment from which the conductor extends. As a result, animals climbing or perching on power transmission and distribution equipment may cause a short circuit or "flashover" between an uninsulated conductor and grounded equipment from which the uninsulated conductor extends. Flashover may result in power outages which are undesirable to electric power suppliers and to electric power consumers. As a result, devices for preventing animals from simultaneously contacting energized and grounded objects have been developed. For example, U.S. Pat. No. 5,864,096 to Williams et al. describes a disk-shaped guard having a number of spaced, concentric circular ring members of electrically insulating material configured to be mounted to insulator bushings of electrical power transmission and distribution equipment. U.S. Pat. No. 5,650,594 to Urnovitz describes a flat member configured to be releasably engaged on an insulator bushing extending from the upper end of a transformer. U.S. Pat. No. 5,794,495 to Anderson describes an animal guard having a pair of semi-circular-shaped body portions configured to be connected to a transformer insulator bushing.

Unfortunately, these existing devices are not designed to cover any portion of an uninsulated conductor extending from an insulator bushing. Because some wildlife, particularly large wildlife, may be able to circumvent these existing devices, it would be desirable to cover a portion of an uninsulated conductor extending from an insulator bushing.

Insulating covers for conductors are available. These covers conventionally include thick rubber tubing, heat-shrinkable tape, and wrap-around covers. Unfortunately, there are drawbacks associated with installing each of these types of covers. Thick rubber tubing can be somewhat bulky and difficult to install. Furthermore, tubing covers may require that a conductor be disconnected from service so that the conductor can be inserted through the tubing. Such electrical power service interruptions may be economically disadvantageous to an electric power supplier as well as being undesirable to electric power consumers.

U.S. Pat. No. 6,005,196 to Spillyards describes a spring-loaded cover configured to be secured about an electrical insulator bushing and a portion of an electrical conductor extending therefrom. U.S. Pat. No. 4,845,307 to Cumming et al. describes a single piece cover having an open slot so that the cover can be pushed or pulled over an electrical insulator bushing.

Unfortunately, a drawback associated with each of these protective covers is that the opening through which an electrical conductor extends may permit the ingress of pests, such as snakes, rodents, and other small animals. In the event that the cover must be removed at a later time, these pests would have to be contended with. In addition, each of these protective covers may be somewhat difficult to install remotely by a technician using a manipulator tool.

SUMMARY OF THE INVENTION

In view of the above, the present invention provides a wildlife guard that surrounds a portion of an electrical insulator bushing and a portion of an electrical conductor extending therefrom, and includes first and second cover portions formed from weather-resistant, electrically insulative material. The first cover portion includes opposite first and second end portions, and first and second elongated edge portions that extend between the first and second end portions. The first end portion of the first cover portion includes a first lever arm that extends beyond the first elongated edge portion. The second cover portion includes opposite third and fourth end portions, and third and fourth elongated edge portions that extend between the third and fourth end portions. The third end portion of the second cover portion includes a second lever arm that extends beyond the third elongated edge portion.

The first and second cover portions are pivotally coupled at the respective first and third end portions at a location intermediate of the first and second lever arms such that when a force is applied to the first and second lever arms by a portion of an electrical insulator bushing, the first and second cover portions pivot together into engagement in a closed position to define a hollow body that surrounds the electrical insulator bushing and a portion of the electrical conductor extending from the electrical insulator bushing. The first and third ends of the respective first and second cover portions are configured to surround an electrical insulator bushing between adjacent skirts when the first and second cover portions are in the closed position.

The second and fourth elongated edge portions each include a respective plurality of flexible fingers extending therefrom. The flexible fingers are in adjacent, contacting relationship when the first and second cover portions are in the closed position. The electrical conductor extends through the flexible fingers when the first and second cover portions are in the closed position.

A latch configured to maintain the first and second cover portions in the closed position may be provided. In addition one or more installation tool attachment points may be provided on the first or second cover portions. The attachment points are configured to be gripped by a manipulator tool used to install the wildlife guard around an electrical insulator bushing.

Wildlife guards according to the present invention are particularly advantageous because they are lightweight and easy to install. Furthermore, a utility technician can use an insulated stick to quickly install a wildlife guard around an energized conductor and bushing without requiring the conductor to be removed from service. Wildlife guards according to the present invention can prevent all types of wildlife including, but not limited to, birds, squirrels, raccoons, snakes, opossums, and raptors from causing flashover between an uninsulated conductor and a grounded object.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout the discussion of the drawings.

Figure 1:
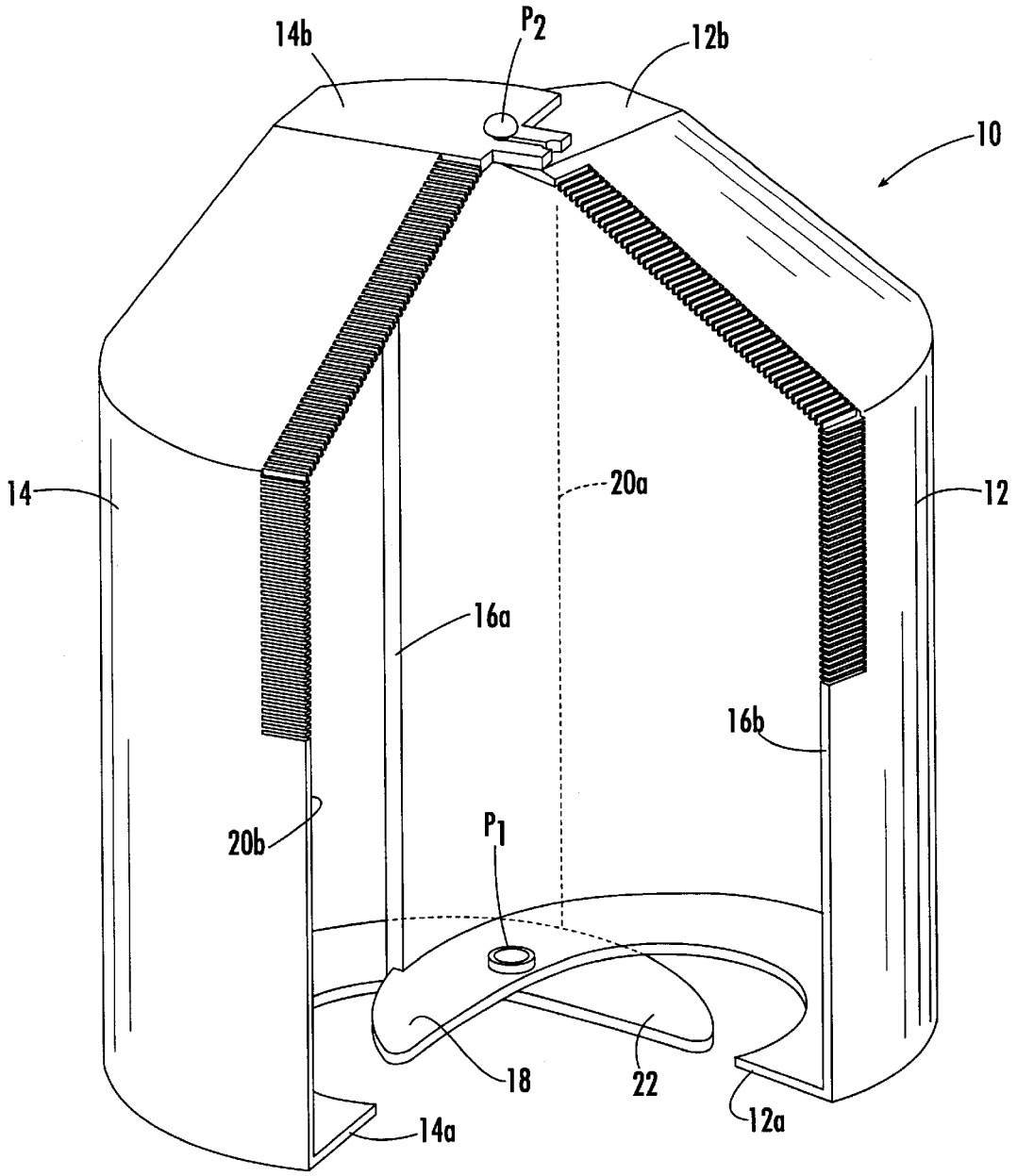
FIG. 1 is a perspective view of a wildlife guard according to an embodiment of the present invention and wherein the first and second cover portions are in an open position.
Figure 2:
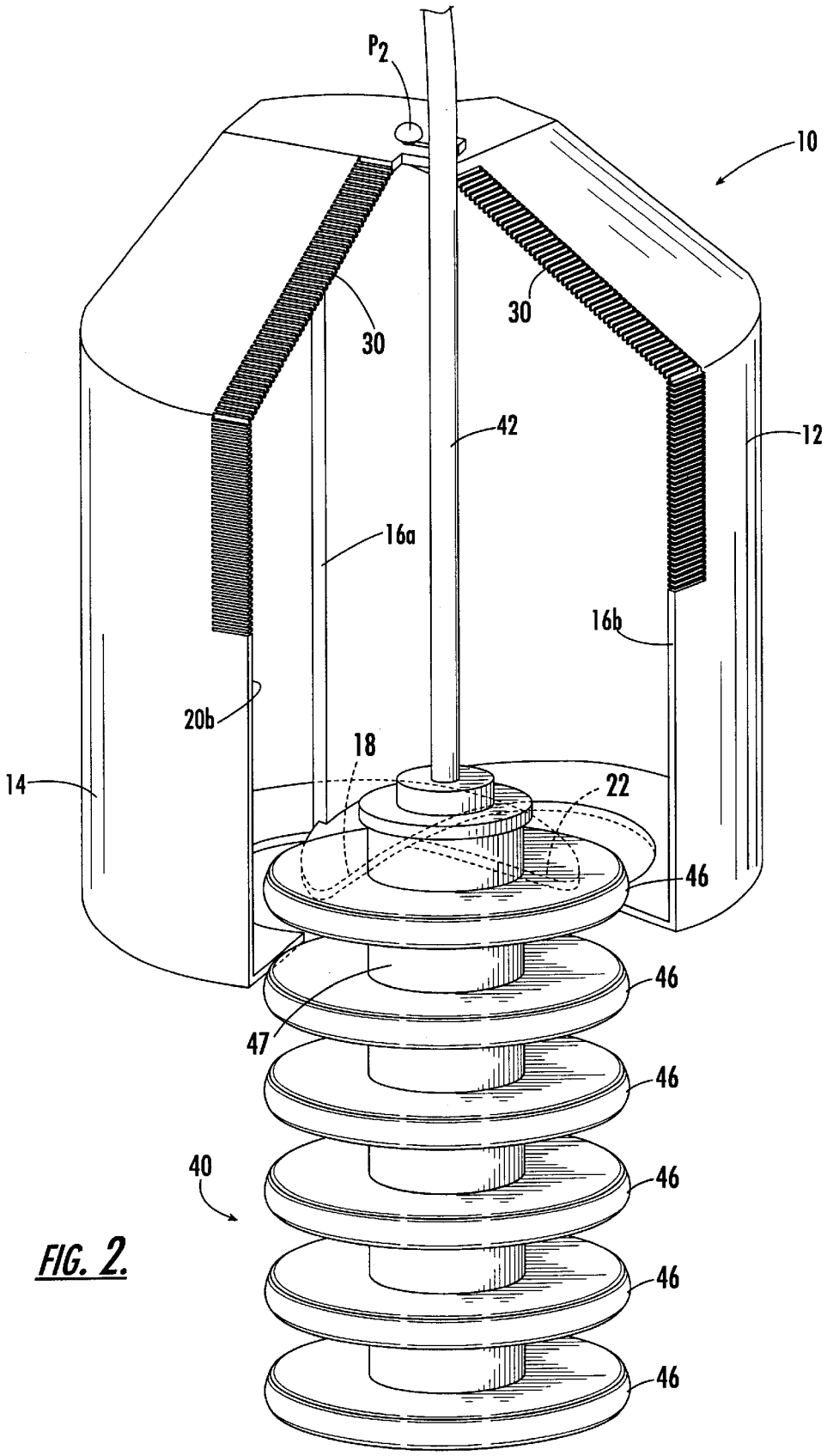
FIG. 2 is a perspective view of the wildlife guard of FIG. 1 wherein the first and second cover portions are in an open position and are being installed around a portion of an electrical insulator bushing and a portion of an electrical conductor extending from the electrical insulator bushing.
Figure 3:
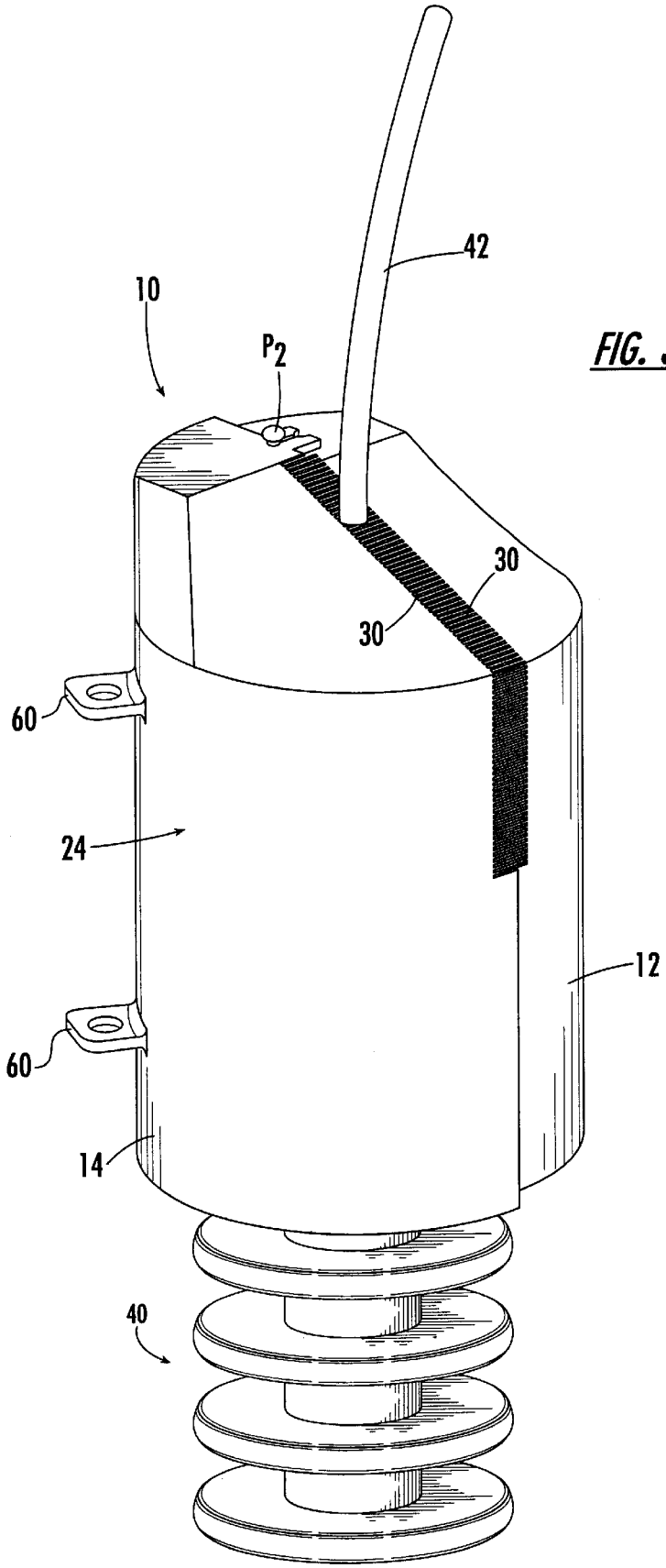
FIG. 3 is a perspective view of the wildlife guard of FIG. 1 installed around the electrical insulator bushing and electrical conductor of FIG. 2.

Referring now to FIGS. 1–3, a wildlife guard 10 for covering an electrical insulator bushing 40 (FIG. 2) and an energized conductor 42 (FIG. 2) extending from the electrical insulator bushing 40, according to an embodiment of the present invention, is illustrated. As is known to those of skill in the art, electrical insulator bushings shield energized electrical conductors extending therefrom and are typically formed from porcelain or other electrically insulative material.

The illustrated wildlife guard 10 includes a pair of first and second cover portions 12, 14 pivotally connected together. The first and second cover portions 12, 14 may have virtually any shape and configuration, without limitation, and are not limited to the illustrated semi-cylindrical configuration. The first cover portion 12 includes opposite first and second end portions 12*a*, 12*b*, and first and second elongated edge portions 16*a*, 16*b* that extend between the first and second end portions 12*a*, 12*b*. The first end portion 12*a* of the first cover portion 12 includes a first lever arm 18 that extends beyond the first elongated edge portion 16*a*, as illustrated.

Similarly, the second cover portion 14 includes opposite third and fourth end portions 14*a*, 14*b*, and third and fourth elongated edge portions 20*a*, 20*b* that extend between the third and fourth end portions 14*a*, 14*b*. The third end portion 14*a* of the second cover portion 14 includes a second lever arm 22 that extends beyond the third elongated edge portion 20*a*, as illustrated.

The first and second cover portions 12, 14 are pivotally coupled at the respective first and third end portions 12*a*, 14*a* at location $P_1$ which is intermediate of the first and second lever arms 18, 22, as illustrated. The first and second cover portions 12, 14 are also pivotally coupled at the respective second and fourth end portions 12*b*, 14*b* at location $P_2$ as illustrated. The configuration of the lever arms 18, 22 is such that when a force is applied to the first and second lever arms 18, 22 by a portion of an electrical insulator bushing, as the wildlife guard 10 is being installed around the electrical bushing (FIG. 2), the first and second cover portions 12, 14 pivot together into engagement in a closed position (see FIG. 3). It is understood that the lever arms 18, 22 can have various configurations and shapes and are not limited to the illustrated configurations.

When in the closed position, the first and second cover portions 12, 14 define a hollow body 24 that surrounds a portion of the electrical insulator bushing 40 and a portion of the electrical conductor 42 extending from the electrical bushing 40, as illustrated in FIG. 3. In the illustrated embodiment of FIG. 3, the first and second cover portions 12, 14 are configured such that the second cover portion 14 snugly overlaps the first cover portion 12 such that no gaps between the first and second cover portions 12, 14 exist when in the closed position.

As illustrated in FIG. 2, the electrical insulator bushing 40 includes an elongated, generally cylindrical body having a plurality of axially spaced-apart skirts 46 extending radially outward therefrom. The first and third ends 12*a*, 14*a* of the respective first and second cover portions 12, 14 are configured to snugly surround the insulator bushing body 40 between adjacent skirts 46 (indicated by 47) when the first and second cover portions 12, 14 are in the closed position. As a result, ingress of wildlife between the insulator bushing body 40 and the first and third ends 12*a*, 14*a* of the respective first and second cover portions 12, 14 can be prevented.

When the electrical insulator bushing and conductor are inserted within the wildlife guard 10 when the first and second cover portions 12, 14 are in the open position, as illustrated in FIG. 2, the portion 47 of the insulator bushing body between adjacent skirts 46 presses against the first and second lever arms 18, 22 and causes the first and second cover portions 12, 14 to move to the closed position (see FIG. 3).

As illustrated in FIGS. 1–3, the second and fourth elongated edge portions 16*b*, 20*b* of the first and second cover portions 12, 14 each include a respective plurality of flexible fingers 30 extending therefrom. Referring to FIG. 3, the flexible fingers 30 are in adjacent, contacting relationship when the first and second cover portions 12, 14 are in the closed position. The flexible fingers 30 permit the electrical conductor 42 to extend therethrough when the first and second cover portions 12, 14 are in the closed position. In addition, the flexible fingers 30 prevent the ingress of wildlife into the hollow body 24 at the point where the electrical conductor 42 extends from the hollow body 24 when the first and second cover portions 12, 14 are in the closed position. Preferably, the flexible fingers 30 are integrally molded with the first and second cover portions 12, 14.

Preferably, the first and second cover portions 12, 14 and flexible fingers 30 are formed from weather-resistant, electrically insulative material, such as polypropylene, high-density polyethylene, polyvinylchloride, and rubber. In the illustrated embodiment of FIGS. 1–3, the second end portion 12*b* of the first cover portion 12 and the fourth end portion 14*b* of the second cover portion 14 have tapered configurations. It is understood that the first and second cover portions may have various shapes and configurations without limitation.

Figure 4:
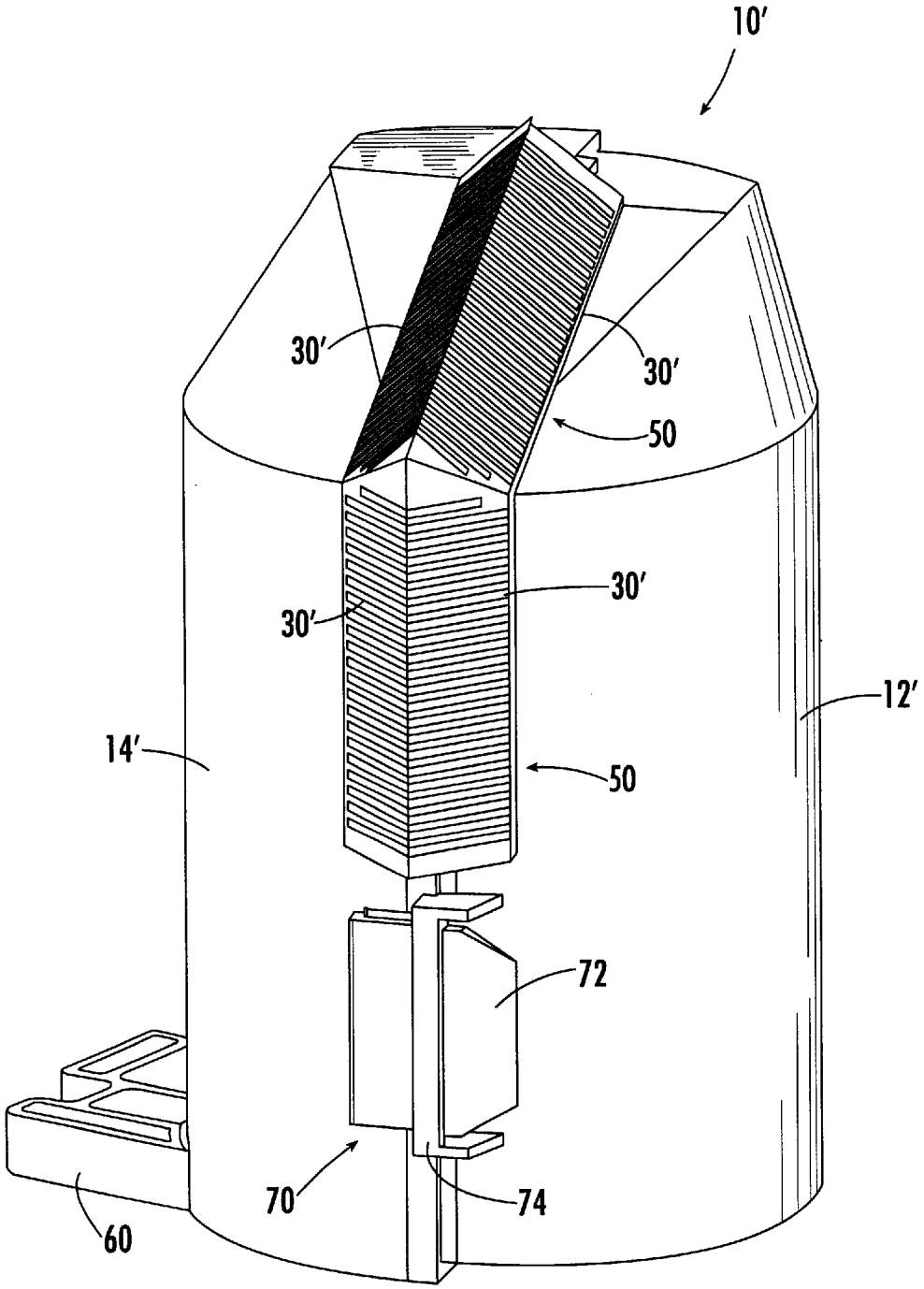
FIG. 4 is a perspective view of a wildlife guard according to another embodiment of the present invention and wherein the first and second cover portions are in a closed position.

According to another embodiment of the present invention illustrated in FIG. 4, flexible fingers 30' may extend outwardly from the respective first and second cover portions 12', 14' at an angle. In the illustrated embodiment of FIG. 4, the flexible fingers 30' extending outwardly from the respective first and second cover portions 12', 14' and form respective elongated, peaked structures 50 through which an electrical conductor may extend.

As illustrated in FIG. 4, the first and second cover portions 12', 14' may include a latch mechanism 70 configured to maintain the first and second cover portions 12', 14' in the closed position. Preferably, the latch mechanism 70 is configured to engage when the first and second cover portions 12', 14' are moved to the closed position. In the illustrated embodiment, the latch mechanism 70 includes a flexible tab 72 attached to the second cover portion 14', and a collar 74 configured to engage the flexible tab 72, as illustrated, so as to hold the first and second cover portions 12', 14' in the closed position. Various latch mechanisms may be utilized with wildlife guards according to the present invention. The present invention is not limited to the illustrated latch mechanism 70.

The wildlife guards 10, 10' illustrated in FIGS. 1–3 and FIG. 4, respectively, also include at least one attachment feature 60 extending from the second cover portion 14 (FIGS. 1–3), 14' (FIG. 4). Each attachment feature 60 is configured to be gripped by a manipulator tool used by a technician when installing the wildlife guard 10, 10' around an electrical insulator bushing. An exemplary manipulator device is referred to as a "hot stick" in the electrical power industry. Hot sticks are available from Hastings Fiber Glass Products, Inc., Hastings MI and A. B. Chance, Co., Centralia, MO. It is understood that attachment features 60 may extend from either the first or second cover portions 12, 14 (FIGS. 1–3), 12', 14' (FIG. 4) and may have various configurations without limitation.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A wildlife guard for an electrical insulator bushing having an electrical conductor extending outwardly therefrom, the wildlife guard comprising:

a first cover portion, comprising:

opposite first and second end portions; and first and second elongated edge portions that extend between the first and second end portions; and a second cover portion, comprising:

opposite third and fourth end portions; and third and fourth elongated edge portions that extend between the third and fourth end portions;

wherein the first and second cover portions are pivotally coupled so as to pivot together into engagement in a closed position to define a hollow body that surrounds the electrical insulator bushing and a portion of the electrical conductor extending from the electrical insulator bushing and to pivot away from engagement to an open position; and wherein the second and fourth elongated edge portions each comprise a respective plurality of flexible fingers extending therefrom, wherein the flexible fingers extending from the second and fourth elongated edge portions are in adjacent, contacting relationship when the first and second cover portions are in the closed position, and wherein the electrical conductor extends through the flexible fingers that extend from the second and fourth elongated edge portions when the first and second cover portions are in the closed position.

2. The wildlife guard according to claim 1:

wherein the first end portion of the first cover portion includes a first lever arm that extends beyond the first elongated edge portion of the first cover portion; wherein the third end portion of the second cover portion includes a second lever arm that extends beyond the third elongated edge portion of the second cover portion; and wherein the first and second cover portions are pivotally coupled at the respective first and third end portions at a location intermediate of the first and second lever arms such that when a force is applied to the first and second lever arms, the first and second cover portions are moved to the closed position.

3. The wildlife guard according to claim 1 wherein the electrical insulator bushing comprises an elongated body having a plurality of axially spaced-apart skirts, and wherein the first and third ends of the respective first and second cover portions are configured to surround a portion of the elongated body between adjacent skirts when the first and second cover portions are in the closed position.

4. The wildlife guard according to claim 1 wherein the first and second cover portions comprise weather-resistant, electrically insulative material.

5. The wildlife guard according to claim 1 further comprising a latch configured to maintain the first and second cover portions in the closed position.

6. The wildlife guard according to claim 1 further comprising at least one attachment feature extending from at least one of the first and second cover portions, wherein the at least one attachment feature is configured to be gripped by a manipulator tool used to install the wildlife guard.

7. The wildlife guard according to claim 1 wherein the flexible fingers extending from the second and fourth elongated edge portions extend outwardly from the respective first and second cover portions.

8. A wildlife guard for an electrical insulator bushing having an electrical conductor extending outwardly therefrom, the wildlife guard comprising:

a first cover portion, comprising:

opposite first and second end portions;

first and second elongated edge portions that extend between the first and second end portions; and wherein the first end portion of the first cover portion includes a first lever arm that extends beyond the first elongated edge portion of the first cover portion; and a second cover portion, comprising:

opposite third and fourth end portions;

third and fourth elongated edge portions that extend between the third and fourth end portions; and wherein the third end portion of the second cover portion includes a second lever arm that extends beyond the third elongated edge portion of the second cover portion; and wherein the first and second cover portions are pivotally coupled at the respective first and third end portions at a location intermediate of the first and second lever arms such that when a force is applied to the first and second lever arms by a portion of the electrical insulator bushing, the first and second cover portions pivot together into engagement in a closed position to define a hollow body that surrounds a portion of the electrical insulator bushing and a portion of the electrical conductor extending from the electrical insulator bushing.

9. The wildlife guard according to claim 8 wherein the second and fourth elongated edge portions each comprise a respective plurality of flexible fingers extending therefrom, wherein the flexible fingers extending from the second and fourth elongated edge portions are in adjacent, contacting relationship when the first and second cover portions are in the closed position, and wherein the electrical conductor extends through the flexible fingers of the second and fourth elongated edge portions when the first and second cover portions are in the closed position.

10. The wildlife guard according to claim 9 wherein the flexible fingers extending from the second and fourth elongated edge portions extend outwardly from the respective first and second cover portions.

11. The wildlife guard according to claim 8 wherein the electrical insulator bushing comprises an elongated body having a plurality of axially spaced-apart skirts, and wherein the first and third ends of the respective first and second cover portions are configured to surround a portion of the elongated body between adjacent skirts when the first and second cover portions are in the closed position.

12. The wildlife guard according to claim 8 wherein the first and second cover portions comprise weather-resistant, electrically insulative material.

13. The wildlife guard according to claim 8 further comprising a latch configured to maintain the first and second cover portions in the closed position.

14. The wildlife guard according to claim 8 further comprising at least one attachment feature extending from at least one of the first and second cover portions, wherein the at least one attachment feature is configured to be gripped by a manipulator tool used to install the wildlife guard.

* * * * *